US009539734B1

(12) United States Patent
Bozikis et al.

(10) Patent No.: US 9,539,734 B1
(45) Date of Patent: Jan. 10, 2017

(54) SHAVING RAZORS AND SHAVING CARTRIDGES

(71) Applicant: BIC VIOLEX S.A., Anixi (GR)

(72) Inventors: Ioannis Bozikis, Koukaki-Athens (GR); Spiros Gratsias, Kypseli-Athens (GR); Christoforos-Athanasios Brellis, Neapoli-Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 14/964,745

(22) Filed: Dec. 10, 2015

Related U.S. Application Data

(60) Provisional application No. 62/261,389, filed on Dec. 1, 2015.

(51) Int. Cl.
*B26B 21/22* (2006.01)
*B26B 21/40* (2006.01)

(52) U.S. Cl.
CPC ..... *B26B 21/227* (2013.01); *B26B 21/4012* (2013.01)

(58) Field of Classification Search
CPC .... B26B 21/227; B26B 21/4012; B26B 21/16; B26B 21/165; B26B 21/02; B26B 21/06; B26B 21/222; B26B 21/4068; B26B 21/4075; Y10T 24/44043; Y10T 24/4406
USPC ..... 30/47–51, 62–68
See application file for complete search history.

(56) References Cited

U.S. PATENT DOCUMENTS 1,455,726 A * 5/1923 Hartman ..... B26B 21/52 30/529
3,821,851 A * 7/1974 Kuhnl ..... B26B 21/24 30/40.2
4,184,247 A * 1/1980 Poisson ..... B26B 21/30 30/58
4,241,501 A 12/1980 Westlake, Jr.
4,378,633 A 4/1983 Jacobson
4,679,324 A * 7/1987 Kirk ..... B26B 21/4068 30/346.58
5,063,667 A 11/1991 Jacobson
5,092,042 A 3/1992 Miller et al.
(Continued)

FOREIGN PATENT DOCUMENTS

EP 0290025 5/1988
WO 8103141 A 11/1981
(Continued)

OTHER PUBLICATIONS

Definition of "clamp" accessed at http://www.merriam-webster.com/dictionary/clamp on Aug. 2, 2016.*
(Continued)

*Primary Examiner* — Stephen Choi
*Assistant Examiner* — Evan MacFarlane
(74) *Attorney, Agent, or Firm* — Polsinelli

(57) ABSTRACT

A shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, and a pair of retainers each having a top portion, a bottom portion, and a portion connecting the top portion to the bottom portion, the retainers extending along the pair of side edges between the front edge of the housing and the rear edge of the housing.

39 Claims, 8 Drawing Sheets

(56) References Cited

U.S. PATENT DOCUMENTS 5,369,885 A * 12/1994 Ferraro ..... B26B 21/227 30/41
5,497,550 A 3/1996 Trotta et al.
5,501,014 A 3/1996 Hegemann
5,522,137 A 6/1996 Andrews
5,546,660 A 8/1996 Burout et al.
5,560,105 A 10/1996 Ichiyanagi
5,630,275 A 5/1997 Wexler
5,661,907 A 9/1997 Apprille, Jr.
5,669,144 A 9/1997 Hahn et al.
5,761,814 A * 6/1998 Anderson ..... B26B 21/4068 30/50
5,771,591 A 6/1998 Armbruster et al.
5,787,586 A 8/1998 Apprille, Jr. et al.
5,822,869 A 10/1998 Metcalf et al.
5,848,475 A 12/1998 Hill et al.
5,855,071 A 1/1999 Apprille, Jr. et al.
5,915,791 A 6/1999 Yin et al.
5,918,369 A 7/1999 Apprille, Jr. et al.
5,992,268 A 11/1999 Decker et al.
6,009,624 A 1/2000 Apprille, Jr. et al.
6,029,354 A 2/2000 Apprille, Jr. et al.
6,035,537 A 3/2000 Apprille, Jr. et al.
6,044,542 A 4/2000 Apprille, Jr. et al.
6,138,361 A 10/2000 Richard et al.
6,161,287 A 12/2000 Swanson et al.
6,161,288 A 12/2000 Andrews
6,185,823 B1 2/2001 Brown et al.
6,349,471 B1 2/2002 Gruslin et al.
6,397,473 B1 6/2002 Clark
7,168,173 B2 1/2007 Worrick, III
7,178,243 B2 2/2007 Brown et al.
7,197,825 B2 4/2007 Walker et al.
7,200,937 B2 4/2007 Richard et al.
7,272,991 B2 9/2007 Aviza et al.
7,607,230 B2 10/2009 Aviza et al.
7,621,203 B2 11/2009 Aviza
7,669,335 B2 3/2010 Walker et al.
7,681,320 B2 3/2010 Szczepanowski et al.
7,739,797 B2 6/2010 Rawle
8,037,609 B2 10/2011 Nicoll
8,061,039 B2 11/2011 Kwiecien et al.
8,061,041 B2 11/2011 Jessemey et al.
8,065,802 B2 11/2011 Oglesby et al.
8,104,184 B2 1/2012 Walker
8,146,255 B2 4/2012 Denkert et al.
8,166,658 B2 5/2012 Nakasuka
8,186,062 B2 5/2012 Fischer et al.
8,186,063 B2 5/2012 Clarke
8,205,343 B2 6/2012 Winter et al.
8,209,869 B2 7/2012 Royle
8,225,510 B2 7/2012 Peterson et al.
8,236,214 B2 8/2012 Kwiecien
8,281,491 B2 10/2012 Walker et al.
8,286,354 B2 10/2012 Walker, Jr. et al.
8,307,553 B2 11/2012 Follo et al.
8,327,546 B2 12/2012 Tucker et al.
8,359,752 B2 1/2013 Bridges
8,381,406 B2 2/2013 Miyazaki
8,413,334 B2 4/2013 Walker, Jr. et al.
8,429,826 B2 4/2013 Clarke
8,438,736 B2 5/2013 Keene et al.
8,448,338 B2 5/2013 Sherman et al.
8,448,339 B2 5/2013 Walker, Jr. et al.
8,474,144 B2 7/2013 Royle
8,479,398 B2 7/2013 Coresh
8,484,852 B2 7/2013 King
8,499,462 B2 8/2013 Masek et al.
8,528,213 B2 9/2013 Szczepanowski et al.
8,533,961 B2 9/2013 Nicoll et al.
8,544,177 B2 10/2013 Rawle et al.
8,567,068 B2 10/2013 Luxton
8,590,162 B2 11/2013 Park et al.
8,640,342 B2 2/2014 Murgida
8,650,763 B2 2/2014 Howell et al.
8,661,689 B2 3/2014 Fathallah et al.
8,689,448 B2 4/2014 Ren
8,726,518 B2 5/2014 Bruno
8,726,519 B2 5/2014 Clarke et al.
8,732,955 B2 5/2014 Howell et al.
8,769,825 B2 7/2014 Howell et al.
8,782,903 B2 7/2014 Clarke et al.
8,793,880 B2 8/2014 Taub et al.
8,826,543 B2 9/2014 Szczepanowski
8,931,176 B2 1/2015 Johnson et al.
8,973,272 B2 3/2015 Moon et al.
8,984,756 B2 3/2015 Worrick, III
9,015,951 B2 4/2015 Howell et al.
9,061,430 B2 6/2015 Wain
9,073,226 B2 7/2015 Szczepanowski et al.
9,144,914 B2 9/2015 Coresh
9,149,945 B2 10/2015 Tomassetti et al.
9,193,077 B2 11/2015 Worrick
9,216,514 B2 12/2015 Bridges et al.
9,283,685 B2 3/2016 Griffin et al.
9,296,117 B2 3/2016 Fathallah et al.
2003/0159291 A1 8/2003 Clark
2004/0177511 A1* 9/2004 Miyazaki ..... B26B 21/222 30/50
2005/0028372 A1 2/2005 Brown et al.
2005/0102847 A1 5/2005 King
2005/0198825 A1 9/2005 Apprille
2005/0198829 A1 9/2005 Gray et al.
2005/0198837 A1 9/2005 Rawle
2006/0179661 A1 8/2006 Walker et al.
2007/0028450 A1 2/2007 Pennell et al.
2008/0256803 A1 10/2008 Tucker et al.
2008/0307660 A1 12/2008 Clarke
2009/0193659 A1 8/2009 Park et al.
2009/0293281 A1 12/2009 Bruno
2010/0077619 A1* 4/2010 Follo ..... B26B 21/225 30/50
2010/0122464 A1 5/2010 Ndou et al.
2010/0175265 A1* 7/2010 Bozikis ..... B26B 21/227 30/50
2010/0313424 A1 12/2010 Johnson et al.
2010/0313426 A1 12/2010 Royle
2010/0319198 A1 12/2010 Johnson et al.
2011/0146079 A1 6/2011 Clarke et al.
2011/0232099 A1 9/2011 Seo
2011/0232100 A1 9/2011 Park et al.
2011/0232101 A1 9/2011 Park et al.
2011/0289779 A1 12/2011 Volodin et al.
2011/0308089 A1 12/2011 Bridges
2011/0314678 A1 12/2011 Peterson
2012/0023749 A1 2/2012 Ariyanayagam et al.
2012/0087981 A1 4/2012 Wang et al.
2012/0279070 A1 11/2012 Seo
2012/0317818 A1 12/2012 Oglesby et al.
2013/0008029 A1 1/2013 Hill et al.
2013/0031794 A1 2/2013 Duff, Jr. et al.
2013/0067714 A1 3/2013 Szczepanowski et al.
2013/0081274 A1 4/2013 Wain et al.
2013/0081275 A1 4/2013 Wain et al.
2013/0081276 A1 4/2013 Wain et al.
2013/0081289 A1 4/2013 Wain et al.
2013/0081291 A1 4/2013 Wain et al.
2013/0097872 A1* 4/2013 Blatter ..... B26B 21/4018 30/50
2013/0118014 A1 5/2013 Stephens et al.
2013/0160296 A1 6/2013 Park et al.
2013/0160306 A1 6/2013 Howell et al.
2013/0160307 A1 6/2013 Howell et al.
2013/0199346 A1 8/2013 Psimadas et al.
2013/0205595 A1* 8/2013 Bykowski ..... B26B 21/14 30/64
2013/0247395 A1 9/2013 Szczepanowski et al.
2014/0000114 A1 1/2014 Wester et al.
2014/0033538 A1 2/2014 Peterson et al.
2014/0109409 A1 4/2014 Fathallah et al.
2014/0230251 A1 8/2014 Hage et al.
2014/0259675 A1 9/2014 Tucker et al.
2014/0283387 A1 9/2014 Bozikis et al.
2014/0310960 A1 10/2014 Ariyanayagam et al.

(56) References Cited

U.S. PATENT DOCUMENTS

| | | | |
|---|---|---|---|
| 2014/0360021 | A1 | 12/2014 | Sonnenberg et al. |
| 2014/0373362 | A1 | 12/2014 | Bozikis |
| 2015/0068043 | A1 | 3/2015 | Gester et al. |
| 2015/0082638 | A1 | 3/2015 | Georgakis et al. |
| 2015/0090085 | A1 | 4/2015 | Griffin et al. |
| 2015/0113816 | A1 | 4/2015 | Szczepanowski et al. |
| 2015/0121703 | A1 | 5/2015 | Bridges et al. |
| 2015/0128424 | A1 | 5/2015 | Witkus et al. |
| 2015/0151443 | A1 | 6/2015 | Worrick, III |
| 2015/0174773 | A1 | 6/2015 | Hodgson |
| 2015/0174774 | A1 | 6/2015 | Hodgson |
| 2015/0174775 | A1 | 6/2015 | Hodgson |
| 2015/0174776 | A1 | 6/2015 | Hawes |
| 2015/0190936 | A1 | 7/2015 | Griffin et al. |
| 2015/0190937 | A1 | 7/2015 | Brormann |
| 2015/0197018 | A1 | 7/2015 | Heubach et al. |
| 2015/0197019 | A1 | 7/2015 | Hodgson et al. |
| 2015/0197020 | A1 | 7/2015 | Hodgson et al. |
| 2015/0197021 | A1 | 7/2015 | Hodgson et al. |
| 2015/0266190 | A1 | 9/2015 | Bohmer et al. |
| 2015/0273711 | A1 | 10/2015 | Wang et al. |
| 2015/0290819 | A1 | 10/2015 | Giannopoulos et al. |
| 2015/0298327 | A1 | 10/2015 | Tomassetti et al. |
| 2015/0314465 | A1 | 11/2015 | Giannopoulos et al. |
| 2015/0314466 | A1 | 11/2015 | Papadopoulos-Papageorgis et al. |
| 2015/0321366 | A1 | 11/2015 | Papadopoulos-Papageorgis et al. |
| 2015/0328786 | A1 | 11/2015 | Shimizu et al. |
| 2016/0023363 | A1 | 1/2016 | Worrick, III |
| 2016/0039103 | A1 | 2/2016 | Worrick, III |

FOREIGN PATENT DOCUMENTS

| | | | |
|---|---|---|---|
| WO | 8602310 | A | 4/1986 |
| WO | 8910245 | A | 11/1989 |
| WO | 9111301 | A | 8/1991 |
| WO | 9119597 | A | 12/1991 |
| WO | 9322112 | A | 11/1993 |
| WO | 9404325 | A | 3/1994 |
| WO | 9408763 | A | 4/1994 |
| WO | 9504638 | A | 2/1995 |
| WO | 9505272 | A | 2/1995 |
| WO | 9605949 | A | 2/1996 |
| WO | 9610473 | A | 4/1996 |
| WO | 9630172 | A | 10/1996 |
| WO | 9632233 | A | 10/1996 |
| WO | 9717174 | A | 5/1997 |
| WO | 9737818 | A | 10/1997 |
| WO | 9737819 | A | 10/1997 |
| WO | 9916591 | A | 4/1999 |
| WO | 9939883 | A | 8/1999 |
| WO | 9952688 | A | 10/1999 |
| WO | 9955499 | A | 11/1999 |
| WO | 0165964 | A | 9/2001 |
| WO | 0211959 | A | 2/2002 |
| WO | 2005077614 | A | 8/2005 |
| WO | 2005090015 | A | 9/2005 |
| WO | 2007015220 | A | 2/2007 |
| WO | 2007042985 | A | 4/2007 |
| WO | 2007147420 | A | 12/2007 |
| WO | 2008129497 | A | 10/2008 |
| WO | 2008129498 | A | 10/2008 |
| WO | 2009027747 | A | 3/2009 |
| WO | 2009027748 | A | 3/2009 |
| WO | 2009027910 | A | 3/2009 |
| WO | 2009154921 | A | 12/2009 |
| WO | 2010059652 | A | 5/2010 |
| WO | 2011011237 | A | 1/2011 |
| WO | 2011094887 | A | 8/2011 |
| WO | 2011106370 | A | 9/2011 |
| WO | 2011159654 | A | 12/2011 |
| WO | 2012003159 | A | 1/2012 |
| WO | 2012070038 | A | 5/2012 |
| WO | 2012158142 | A | 11/2012 |
| WO | 2013122900 | A | 8/2013 |
| WO | 2014051843 | A | 4/2014 |
| WO | 2014191844 | A | 12/2014 |
| WO | 2014197667 | A | 12/2014 |
| WO | 2015082002 | A | 6/2015 |
| WO | 2015090385 | A | 6/2015 |
| WO | 2015094599 | A | 6/2015 |
| WO | 2015094615 | A | 6/2015 |
| WO | 2015094616 | A | 6/2015 |
| WO | 2015125021 | A | 8/2015 |
| WO | 2015050747 | A | 9/2015 |
| WO | 2015134700 | A | 11/2015 |

OTHER PUBLICATIONS

Complete text of U.S. Pat. No. 3,821,851 to Kuhnl published by the USPTO.*

* cited by examiner

SHAVING RAZORS AND SHAVING CARTRIDGES

CROSS-REFERENCE TO RELATED APPLICATIONS

This application claims the benefit of U.S. Provisional Application No. 62/261,389, filed Dec. 1, 2015, which is hereby incorporated by reference in its entirety for all purposes.

STATEMENT REGARDING FEDERALLY SPONSORED RESEARCH OR DEVELOPMENT

Not applicable.

BACKGROUND OF THE INVENTION

1. Field of the Invention

The following description relates to shaving razors and shaving cartridges. A shaving razor or shaving cartridge may include one or more blades and one or more retainers for retaining elements of the shaving razor or shaving cartridge. For example, a pair of c-shaped retainers extending along a pair of side edges of the shaving cartridge retains the blades in position within the housing.

2. Description of Related Art

Typically, a conventional razor head includes one or more razor blades secured to a razor head housing. A number of different securing mechanisms are typically used for securing razor blades. Such conventional mechanisms include clip retaining elements that wrap around the front and rear edges of a razor head housing and clip retaining elements that extend through one or more pairs of apertures adjacent to the front and rear ends of the housing.

For example, U.S. Pat. No. 6,035,537 describes a pair of clips that wrap around the front and rear ends of a razor housing for securing blades within the housing. U.S. Pat. No. 8,286,354 describes a razor head including two pairs of apertures formed in the body of the razor cartridge for receiving a pair of clips to retain the razor blades within the housing. U.S. Patent Application Publication No. 2015/0090085 describes a razor head including a pair of apertures and a pair of clips that extend through the pair of apertures on one end and wrap around the housing on the other end.

FIGS. 11A-11B are diagrams illustrating a prior art shaving cartridge. Referring to FIGS. 11A-11B a conventional razor cartridge 10 includes a pair of clips 15 that extend through apertures formed on both ends of the razor cartridge. The clips 15 extend over the razor blades from a front edge of the housing adjacent to a guard bar to a rear edge of the housing adjacent to the cap.

Several disadvantages are typically encountered in the use and manufacture of conventional razor cartridges such as the razor cartridge 10 illustrated in FIGS. 11A-11B. During the manufacturing process, clips 15 may encounter buckling as a result of the force that is applied in bending the legs of the clips 15. As a result of the bending force exerted on the clips 15, the clips 15 have a tendency to buckle upwards. Therefore, the blade exposures may be unstable throughout the razor cartridge 10 and may vary significantly from the intended blade exposure values.

Also, during the manufacturing of the razor cartridge 10, one or more legs of the clips 15 may fail to be bent. That is, after manufacturing of the razor cartridge 10 is completed, additional attention and labor may be required to ensure that all the clips are properly secured and all the clip legs are properly bent beneath the housing of the razor cartridge 10. Where a clip leg is not secured, additional steps are required to bend the clip leg beneath the housing.

Further, manufacturing of the razor cartridge 10 is a multi-step process that typically includes providing clips 15 having specific dimensions and materials that may need to be manufactured and supplied by a third party vendor, positioning the clips 15 at the proper position, placing the clip legs through one or more pairs of apertures or wrapping the clip legs around the housing, and bending the clip legs after securing the clips 15 to the one or more pairs of apertures. This manufacturing process is timely and costly, and typically requires multiple steps and a third party manufacturer and vendor.

It should also be appreciated that the razor cartridge 10 including the clips 15 provides a variable retaining force throughout the length of the clips 15. Because the clips are secured 15 to the razor cartridge 10 at only the front and rear ends thereof, the retaining forces throughout the length of the clips 15 is variable.

SUMMARY OF THE INVENTION

In an embodiment of the present invention, a shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, and a pair of substantially c-shaped retainers each having a top portion, a bottom portion, a substantially convex portion connecting the top portion to the bottom portion, the retainers extending along the pair of side edges between the front edge of the housing and the rear edge of the housing, where the top portion of each of the retainers is substantially planar and the bottom portion of each of the retainers is curved.

In another embodiment of the present invention, a shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, a pair of substantially c-shaped retainers each having a top portion, a bottom portion, a substantially convex portion connecting the top portion to the bottom portion, and an inner surface, the retainers extending along the pair of side edges between the front edge of the housing and the rear edge of the housing, where the top portion of each of the retainers is substantially planar and the bottom portion of each of the retainers is curved, and a protrusion disposed on the inner surface.

In yet another embodiment of the present invention, a shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, a pair of substantially c-shaped retainers each having a top portion, a bottom portion, a substantially convex portion connecting the top portion to the bottom portion, an inner surface, a front edge, and a rear edge, the retainers extending along the pair of side edges between the front edge of the housing and the rear edge of the housing, where the top portion of each of the retainers is substantially planar and the bottom portion of each of the retainers is curved, a protrusion disposed on the inner surface, and a recess disposed on the top portion of each of the retainers and extending from the front edge of the retainer to the rear edge of the retainer.

In an additional embodiment of the present invention, a shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, and a pair of substantially c-shaped retainers each having a top portion, a bottom portion, a substantially convex portion connecting the top surface to the bottom surface, the retainers extending along the pair of side edges between the front edge of the housing and the rear edge of the housing, where each of the retainers is preloaded thereby securing the retainer to the housing.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present invention is not limited to the precise embodiments and features shown. The accompanying drawings, which are incorporated in and constitute a part of this specification, illustrate an implementation of apparatuses consistent with the present invention and, together with the description, serve to explain advantages and principles consistent with the present invention.

DETAILED DESCRIPTION OF THE INVENTION

Figure 1:
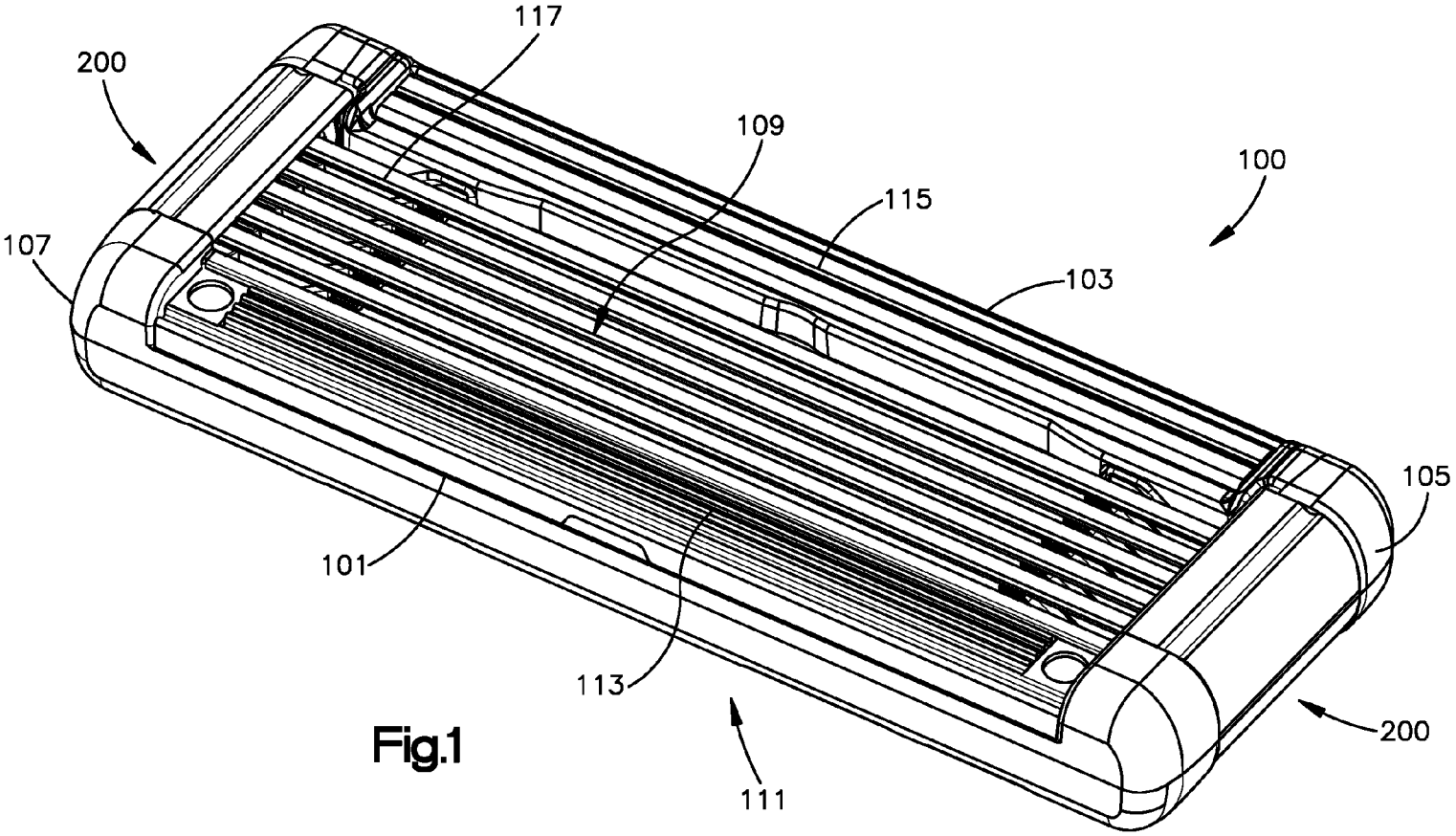
FIG. 1 is a diagram illustrating a perspective view of an example of a shaving cartridge including retainers for securing blades to the cartridge.

It is to be understood that the present invention is not limited in its application to the details of construction and to the embodiments of the components set forth in the following description or illustrated in the drawings. The figures and written description are provided to teach any person skilled in the art to make and use the inventions for which patent protection is sought. The present invention is capable of other embodiments and of being practiced and carried out in various ways. Persons of skill in the art will appreciate that the development of an actual commercial embodiment incorporating aspects of the present inventions will require numerous implementations—specific decisions to achieve the developer's ultimate goal for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the figures and are not intended to limit the scope of the present invention or the appended claims. Further, it should be understood that any one of the features of the present invention may be used separately or in combination with other features. Other systems, methods, features, and advantages of the present invention will be or become apparent to one with skill in the art upon examination of the figures and the detailed description. It is intended that all such additional systems, methods, features, and advantages be included within this description, be within the scope of the present invention, and be protected by the accompanying claims.

Further, the term "substantially" as used in the description and the appended claims should be understood to include an exact or not exact configuration. For example, substantially c-shaped means having an exact c-shape or not exact c-shape. Also, a substantially planar surface means having an exact planar surface or not exact planar surface. Also, the term "about" or "approximately" as used in the description and the appended claims should be understood to include the recited values or a value that is three times greater or one third of the recited values. For example, about 3 mm includes all values from 1 mm to 9 mm, and approximately 50 degrees includes all values from 16.6 degrees to 150 degrees.

It will be appreciated by those skilled in the art that changes could be made to the embodiments described above without departing from the broad inventive concept thereof. It is understood, therefore, that the present invention disclosed herein is not limited to the particular embodiments disclosed, but it is intended to cover modifications within the spirit and scope of the present invention as defined by the appended claims.

FIG. 1 is a diagram illustrating a perspective view of an example of a shaving cartridge 100 including retainers 200 for securing blades 117 to the cartridge 100.

Referring to FIG. 1, the shaving cartridge 100 includes a housing having a front edge 101, a rear edge 103, a pair of side edges 105, 107, a top surface 109, and a bottom surface 111. The pair of side edges 105, 107 extend between the front edge 101 of the housing and the rear edge 103 of the housing. The shaving cartridge 100 includes a guard bar 113 adjacent to the front edge 101 of the housing and a cap 115 adjacent to the rear edge 103 of the housing. One or more blades 117 are positioned between the guard bar 113 and the cap 115, and retained in position within the housing using one or more retainers 200. In this example, the shaving cartridge 100 includes five blades 117 that are retained in position within the housing using a pair of retainers 200 but any number of blades may be used.

Figure 2:
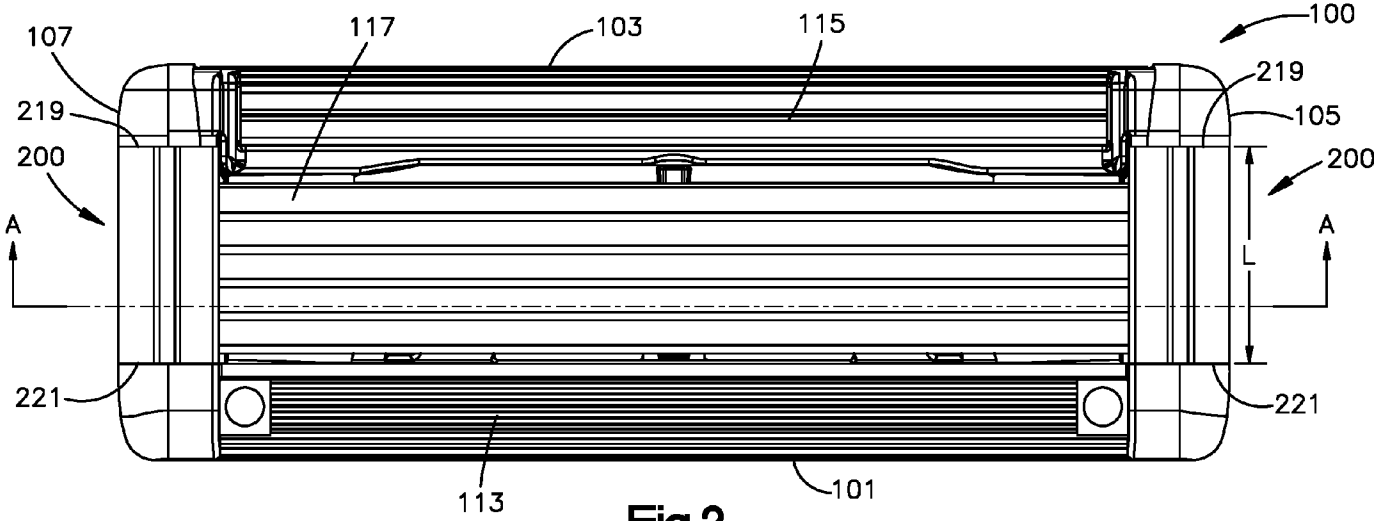
FIG. 2 is a diagram illustrating a top view of the shaving cartridge including the retainers.
Figure 3:
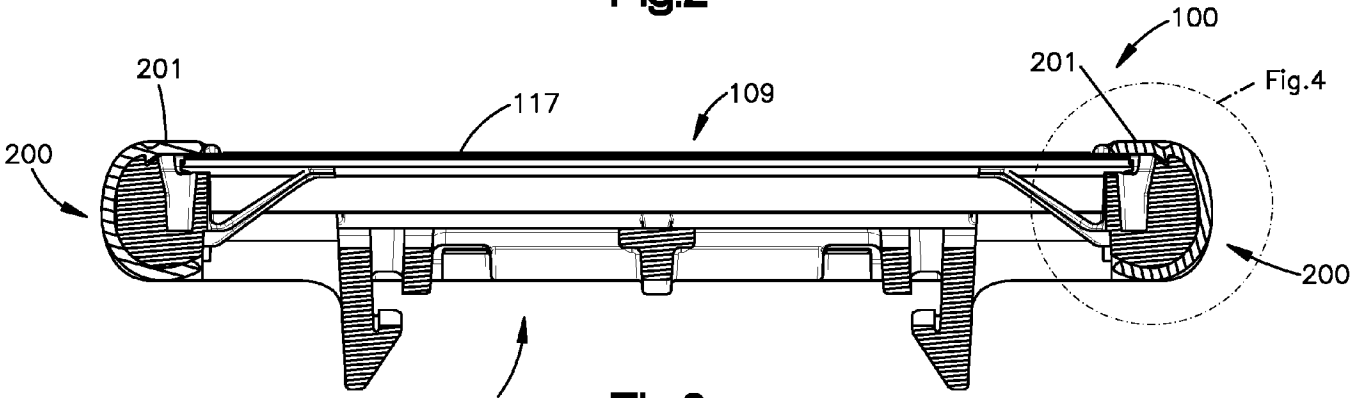
FIG. 3 is a diagram illustrating a cross-sectional view of the shaving cartridge along the line A-A shown in FIG. 2.

FIG. 2 is a diagram illustrating a top view of the shaving cartridge 100 including the retainers 200, and FIG. 3 is a diagram illustrating a cross-sectional view of the shaving cartridge 100 along the line A-A shown in FIG. 2.

Referring to FIGS. 2-3, the retainers 200 are spaced apart and positioned on opposite sides of the housing. The retainers 200 extend along the side edges 105, 107 of the housing and include a top portion 201 that extends above the top surface 109 of the housing and above one or more blades 117 to retain the position of the blades 117 within the housing.

In this example, the retainers 200 extend along a length L on the side edges 105, 107 of about 8.5 mm; however, it should be appreciated that the retainers 200 may extend along a shorter or longer portion of the side edges 105, 107. For example, a pair of retainers 200 may each extend along the entire length, a shorter portion, or a longer portion of the side edges 105, 107. Such extensions may secure in place a guard bar, a cap element, or a trimmer assembly. Further, it should be appreciated that while this example illustrates a pair of retainers 200, any number of retainers may be used with the shaving cartridge 100. For example, a single retainer, four retainers, or any number of retainers may be used to retain the position of the blades 117 within the housing.

Figure 4:
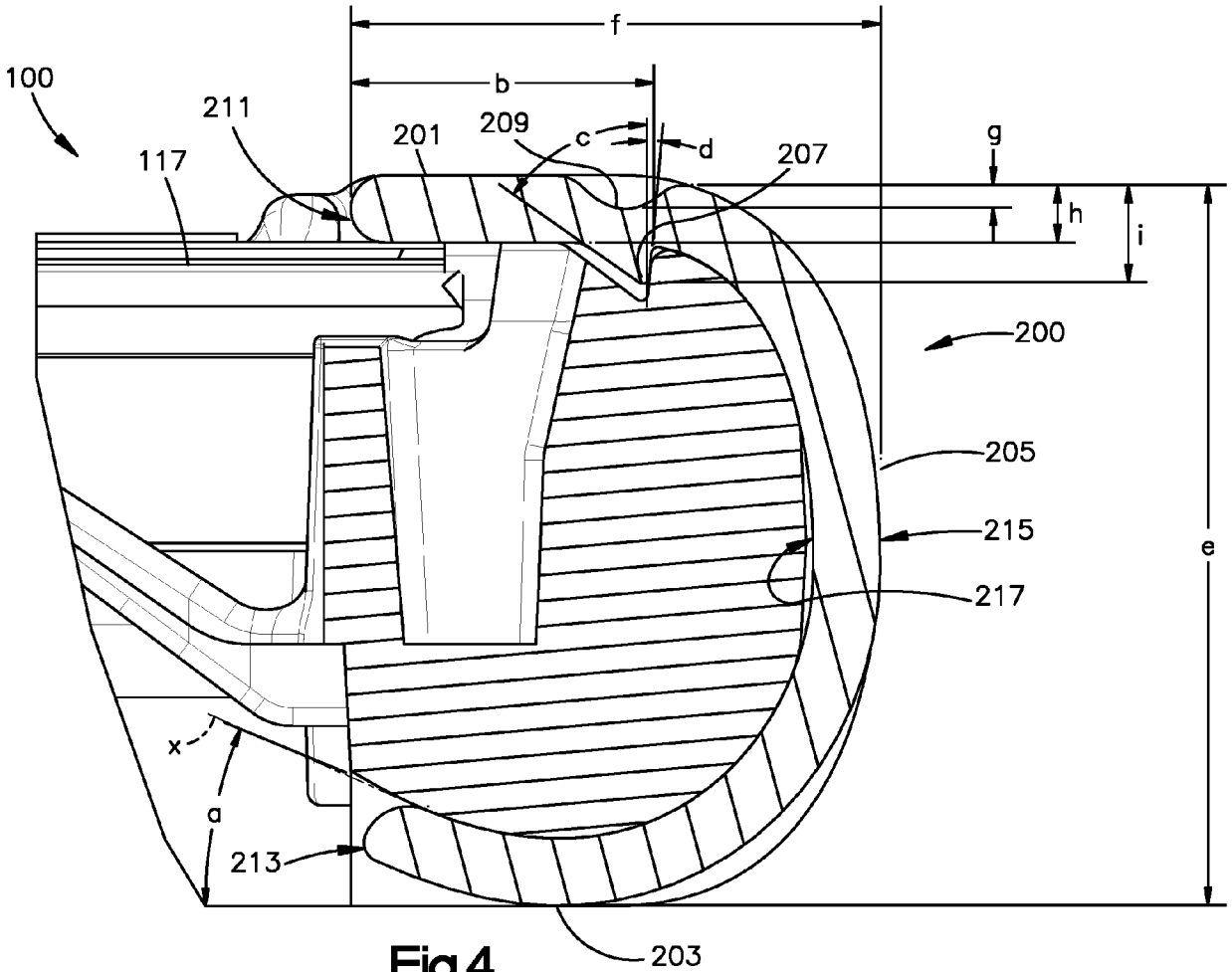
FIG. 4 is a diagram illustrating a magnified cross-sectional view of the shaving cartridge and one of the retainers in the region shown in FIG. 3.

FIG. 4 is a diagram illustrating a magnified cross-sectional view of the shaving cartridge and one of the retainers in the region shown in FIG. 3.

Referring to FIG. 4, the retainer 200 is a substantially c-shaped retainer and includes a top portion 201, a bottom portion 203, and a substantially convex portion 205 connecting the top portion 201 to the bottom portion 203. In addition, the retainer 200 includes a first face 211 on the top portion 201 that is facing towards the blades 117 and a second face 213 on the bottom portion 203 that is facing towards the blades 117. The inner surface 217 of the retainer 200 extends throughout the internal surface of the retainer's top portion 201, bottom portion 203, and convex portion 205, and is in contact with the housing of the cartridge 100. Similarly, the outer surface 215 of the retainer 200 extends throughout the external surface of the retainer's top portion 201, bottom portion 203, and convex portion 205. As shown in FIG. 2, each retainer 200 includes a front edge 221 that is adjacent to the guard bar 113 and a rear edge 219 that is adjacent to the cap 115.

The top portion 201 of the retainer 200 is substantially planar and secures the blades 117 to the housing. For example, the inner surface 217 of the top portion 201 of the retainer 200 is in direct contact with the edges of the blades 117 to maintain the position of the blades 117 and to maintain the blade exposure of each of the blades 117 with respect to a contact plane. The contact plane may refer to a plane that is formed on the surface of the guard bar 113 and the cap 115.

The bottom portion 203 is curved for securing the retainer 200 to the underside of the housing. The substantially convex portion 205 connects the top portion 201 to the bottom portion 203 and includes a curvature. In this example, the curvature of the convex portion 205 includes a plurality of radii and may include one or more straight portions throughout its length. However, it should be appreciated that, in other examples, the convex portion may include a single radius of curvature and the retainer 200 may form a semi-circular shape.

Still referring to FIG. 4, the retainer 200 may include a recess 209 that is formed on the outer surface 215 of the top portion 201 of the retainer 200. Also, in this example, the retainer 200 includes a protrusion 207 that extends from the inner surface 217 of the top portion 201 of the retainer. The protrusion 207 is configured to be received by a corresponding surface 152 on the housing that will be further described below in reference to FIGS. 5-8. The protrusion 207 further secures the retainer 200 to the housing of the cartridge 100.

In this example, the recess 209 further supports the planar stiffness of the top portion 201, and the protrusion 207 anchors the retainer 200 in a fixed position. An example process of manufacturing the retainer 200 includes forming the protrusion 207 and the recess 209 from a punch and die. The die on the inner surface 217 of the retainer 200 is in the shape of the protrusion 207, with adequate offset needs for stamping. The punching of the outer surface 215 of the top portion 201 creates the recess 209 on the outer surface 215 of the top portion 201, and transfers the material of the retainer 200 into the shape of the protrusion 207. The protrusion 207 thus extends from the inner surface 217 of the top portion 201 taking the shape of the die, as illustrated in FIG. 4.

In a preferred example, the retainer 200 has a height e from the uppermost part of the top portion 201 to the lowermost part of the bottom portion 203 that is about 5.4 mm. The distance b from the innermost part of the first face 201 that is closest to the center of the housing to the tip of the protrusion 207 is about 2.2 mm, but may range from about 1 mm to about 3 mm. The distance f from the innermost part of the first face 211 that is closest to the center of the housing to the outermost part of the retainer 200 that is farthest from the center of the housing is about 4 mm but may range from about 3 mm to about 5 mm. The angle a between the horizontal line that is tangent to the lowermost point of the bottom portion 203 and the line x that is tangent to the innermost point on the inner surface of the bottom portion 203 prior to a change in the radius of curvature of the bottom portion is approximately 22 degrees. In a preferred example, this angle is a positive angle that can range from about 0 to about 60 degrees. The value of the angle applied will drive the amount of locking interaction that is needed for a specific head design. The thickness of the retainer 200 may range throughout the length of the retainer 200 with the greatest thickness h being approximately 0.5 mm.

Still referring to FIG. 4, in this example, the protrusion has a triangular shape, and the angle c between the left side of the protrusion 207 and the vertical line that is passing through the tip of the protrusion is about 55 degrees. The angle d between the outer side of the protrusion 207 and the vertical line that is passing through the tip of the protrusion is about 5 degrees. The depth i of the protrusion from the uppermost part of the top portion 201 is about 0.75 mm. The recess 209 preferably has a semi-circular shape and a depth g of the recess from the uppermost part of the top portion 201 is about 0.25 mm.

It should be appreciated by one of ordinary skill in the art that these dimensions and shapes are only an example of the preferred embodiment, a number of other dimensions and shapes may be used for the retainer 200, the protrusion 207, and the recess 209. For example, while the shapes of the protrusion 207 and the recess 209 are triangular and semi-circular, respectively, the shapes of the protrusion and recess may include triangular, oblong, square, rectangular, circular, semi-circular, elliptical, or other related shapes as understood by a person of ordinary skill in the art.

Figure 5:
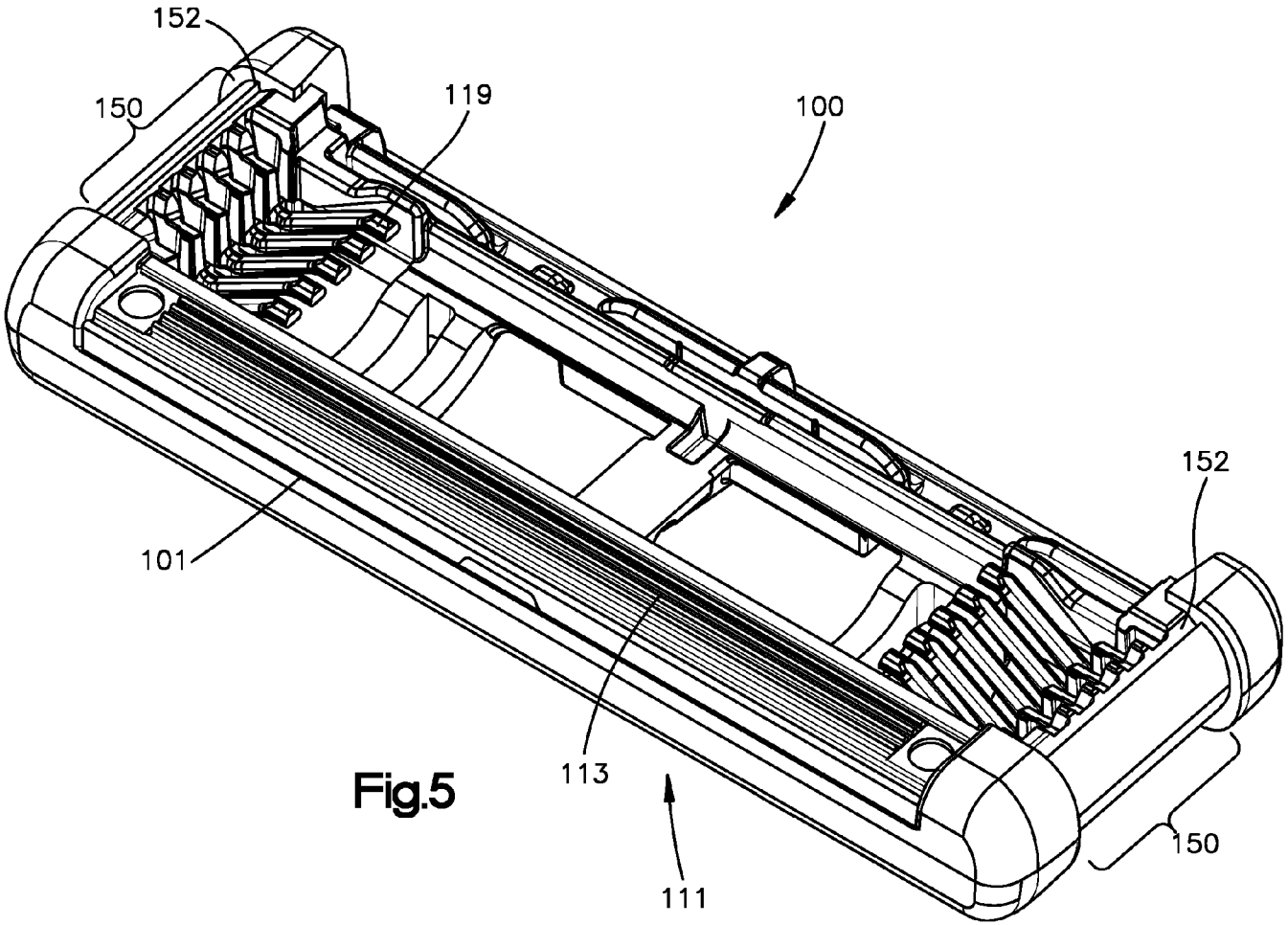
FIG. 5 is a diagram illustrating a perspective view of the shaving cartridge without the retainers.

FIG. 5 is a diagram illustrating a perspective view of the shaving cartridge without the retainers.

Referring to FIG. 5, the shaving cartridge 100 is shown with the retainers 200, the cap 115, and the blades 117 being removed. The shaving cartridge 100 may include one or more springs 119 for supporting the blades 117 and providing independently movable blades 117 within the housing. The shaving cartridge includes a pair of recesses 150 for receiving the pair of retainers 200, each recess 150 having a corresponding surface 152 for receiving the protrusion 207 of the retainer 200. In an example, the recesses 150 may extend along the same length L as the retainers 200 of about 8.5 mm; however, it should be appreciated that a variety of different lengths may be used. In addition, the recess 150 may have a different length than the retainer 200.

Figure 6:
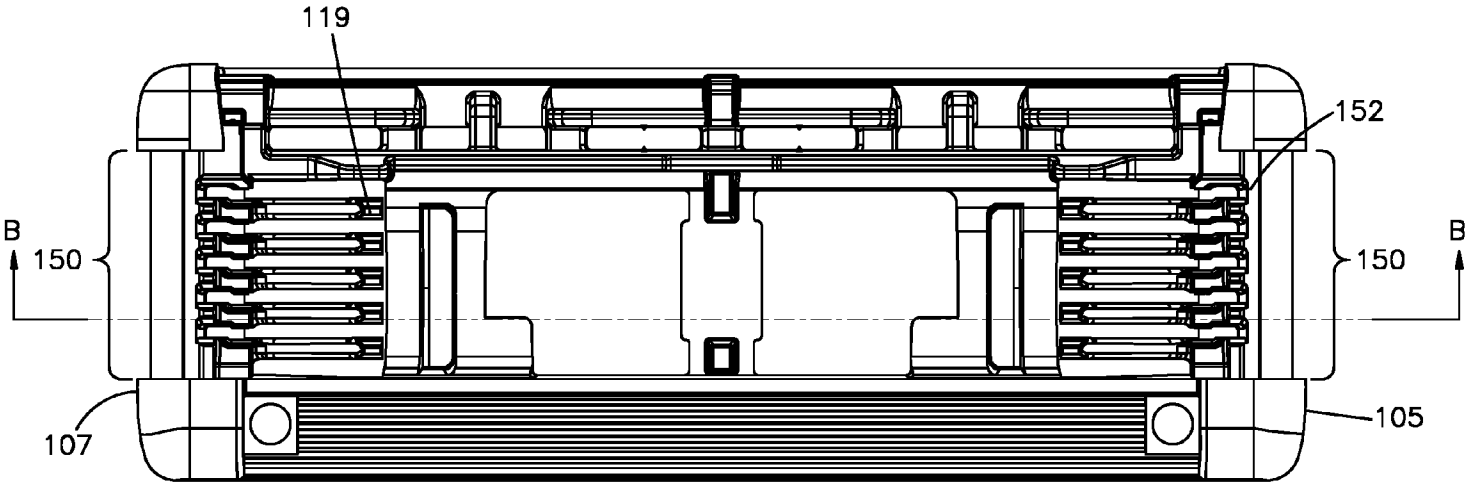
FIG. 6 is a diagram illustrating a top view of the shaving cartridge without the retainers.
Figure 7:
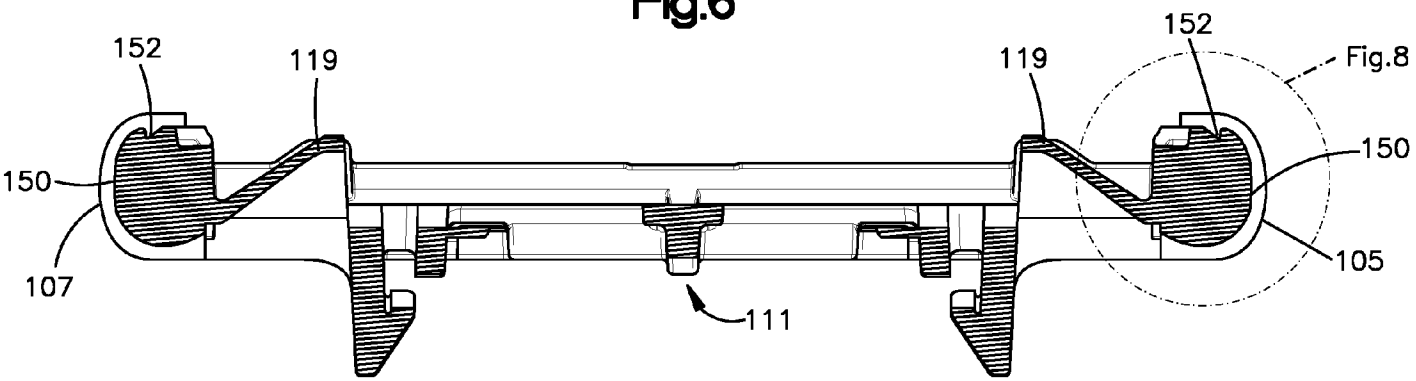
FIG. 7 is a diagram illustrating a cross-sectional view of the shaving cartridge without the retainers along the line B-B shown in FIG. 6.

FIG. 6 is a diagram illustrating a top view of the shaving cartridge 100 without the retainers 200, and FIG. 7 is a diagram illustrating a cross-sectional view of the shaving cartridge 100 without the retainers 200 along the line B-B shown in FIG. 6.

Referring to FIGS. 6-7, as with the retainers 200 described above, the recesses 150 are formed along a portion of the side edges of the housing. The recesses 150 may also be formed along the entire side edges of the housing or along smaller portions of the side edges. Further, the corresponding surface 152 for receiving the protrusion 207 of the retainer 200 may be formed on the upper surface of the recess 150. In this example, the corresponding surface 152 is a triangular recess that is formed on the upper surface of the recess 150. In other examples, the corresponding surface 152 may include a mating surface that is not a recess, or a mating surface that is a recess and has a different shape that corresponds to the shape of the protrusion 207. The springs 119 that are used for supporting the blades 117 may extend from the side of the housing in the region of the recess 150.

Figure 8:
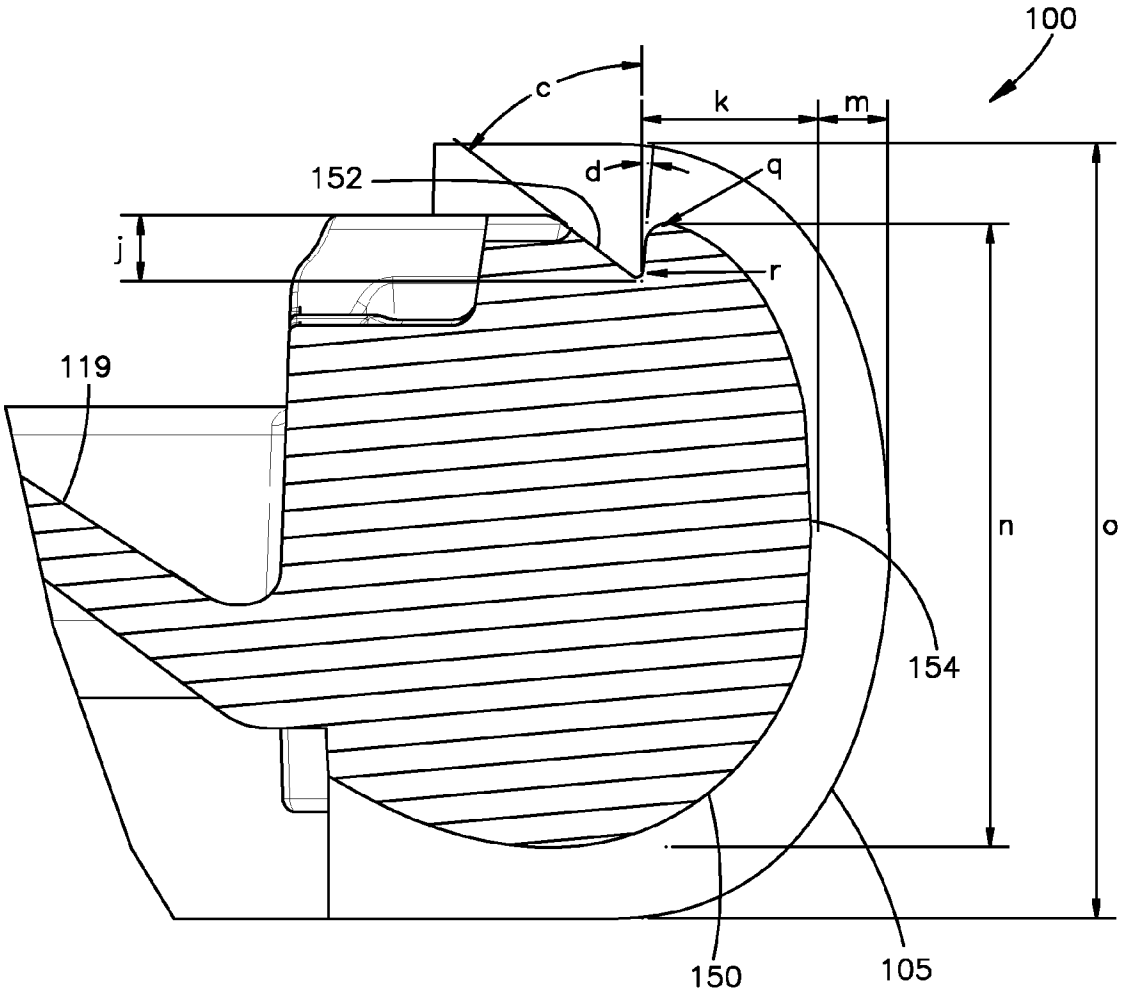
FIG. 8 is a diagram illustrating a magnified cross-sectional view of the shaving cartridge without the retainers in the region shown in FIG. 7.

FIG. 8 is a diagram illustrating a magnified cross-sectional view of the shaving cartridge 100 without the retainers 200 in the region shown in FIG. 7. Referring to FIG. 8, the corresponding surfaces 152 may have a similar shape as the protrusions 207. For example, each corresponding surface 152 has a triangular shape, and the angle c between the left side of the corresponding surface 152 and the vertical line that is passing through the tip of the corresponding surface 152 is about 55 degrees. The angle d between the outer side of the corresponding surface 152 and the vertical line that is passing through the tip of the corresponding surface 152 is about 5 degrees.

In the preferred example, the wall of the housing at the position of the recess 150 may include a substantially flat surface 154 corresponding to the substantially convex portion 205 of the retainer 200. As a result, an air-gap may exist between the inner surface 217 of the retainer 200 and the parting line area. The flat surface 154 is due to the parting line and the need to avoid creating a fulcrum effect with the retainer 200. That is, using a curved surface that is in direct contact with the substantially convex portion 205 at the recess 150, rather than the substantially flat surface 154, may create a fulcrum surface that may push the retainer 200 away from the recess 150 and interfere with the secure attachment of the bottom portion 203 with the underside of the housing. Consequently, it is preferred that the recess 150 include a flat surface 154 for optimal alignment between the retainer 200 and the housing of the razor cartridge 100; however, the razor cartridge 100 of this present invention is not limited to including the substantially flat surface 154. The razor cartridge 100 may include an entirely curved wall at the recess 150, or one or more flat surfaces 154 corresponding to the substantially convex portion 205, top portion 201, or bottom portion 203. An air gap and flat surface 154 may also be applied anywhere that a parting line is designed to ensure the best retainer alignment to the housing.

In this example, the corresponding surface 152 may have a depth j that extends from the top surface of the recess 150 that is approximately 0.4 mm. The distance k from the end of the corresponding surface 152 to the end of the recess 150 may be approximately 1.3 mm. The distance m between the end of the recess 150 and the side edge 105 of the housing where the recess is not formed may be approximately 0.5 mm. The height n of the recess from the uppermost portion to the lowermost portion may be approximately 4.4 mm, and the height o of the side edge 105 of the housing where the recess is not formed may be approximately 5.5 mm. Additionally, the radius of curvature r at the bottom tip of the corresponding surface 152 may be approximately 0.1 mm, and the radius of curvature q at the upper tip of the corresponding surface 152 may be approximately 0.15 mm. It should be appreciated by one of ordinary skill in the art that these dimensions and shapes are only an example of the preferred embodiment, a number of other dimensions and shapes may be used for the recess 150 and the corresponding surface 152.

Figure 9:
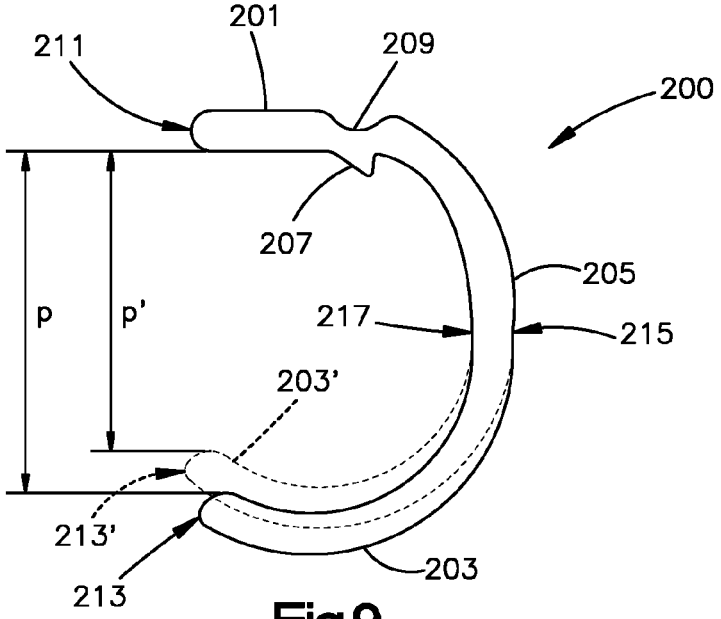
FIG. 9 is a diagram illustrating a side elevation view of an example of a preloaded retainer for securing blades to a razor cartridge as configured prior to being installed and in response to being installed on the razor cartridge.

FIG. 9 is a diagram illustrating a side elevation view of an example of a preloaded retainer for securing blades to a razor cartridge as configured prior to being installed on the razor cartridge 100 and after being installed on the razor cartridge 100.

Referring to FIG. 9, the retainer 200 is a substantially c-shaped retainer and includes a top portion 201, a bottom portion 203, and a substantially convex portion 205 connecting the top portion 201 to the bottom portion 203. In addition, the retainer 200 includes a first face 211 on the top portion 201, a second face 213 on the bottom portion 203, an inner surface 217, and an outer surface 215. The retainer 200 is shown in a configuration prior to being installed on the razor cartridge 100 where the bottom portion 203' is closer to the top portion 200 as compared to the position of the bottom portion 203 after the retainer 200 is installed on the razor cartridge 100. That is, the retainer 200 of this example is a preloaded retainer.

As used in this application, the term "preloaded" hereinafter means having a different configuration in response to being installed in the razor cartridge 100. In this example, prior to being installed in the razor cartridge 100, the retainer 200 has a smaller configuration where the distance p' from the lowermost part of the top portion 201 adjacent to the first face 211 to the uppermost part of the bottom portion 203' adjacent to the second face 213' is approximately 3.8 mm. In response to being installed in the razor cartridge 100, the bottom portion 203 moves downwardly and the distance p from the lowermost part of the top portion 201 adjacent to the first face 211 to the uppermost part of the bottom portion 203 adjacent to the second face 213 is approximately 4.2 mm. In a preferred example, there is an increase of approximately 10 percent in the distance from the top portion 201 to the bottom portion 203 in response to the retainer 200 being installed in the razor cartridge 100. It should be appreciated by one of ordinary skill in the art that these dimensions and ratios are only an example of the preferred embodiment, and a variety of other dimensions and ratios may be used.

In an embodiment, several functional advantages exist for providing a shaving cartridge 100 with a preloaded retainer 200 having a planar top portion 201 and having a bottom curved portion 203. The planar top portion 201 acts as a blade edge reference that may be in direct contact with the blade edges for securing the blades 117 to the razor cartridge 100. The curved bottom portion 203 more tightly secures the retainer 200 to the razor cartridge 100, and the preloaded retainer 200 allows for an even more secure attachment between the retainer 200 and the razor cartridge 100. Because the retainer 200 expands from its original, at-rest configuration in response to being installed in the razor cartridge 100, a spring force formed as a result of being stretched beyond its at-rest position further secures the retainer 200 to the razor cartridge 100.

Figure 10:
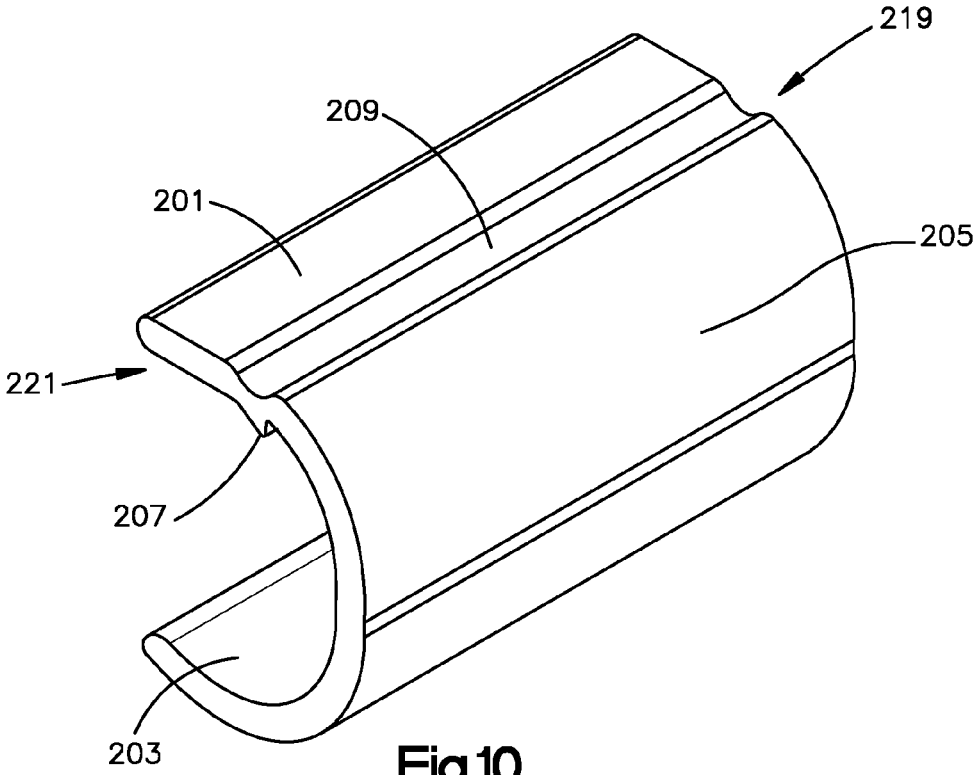
FIG. 10 is a diagram illustrating a perspective view of the retainer.
Figure 11A:
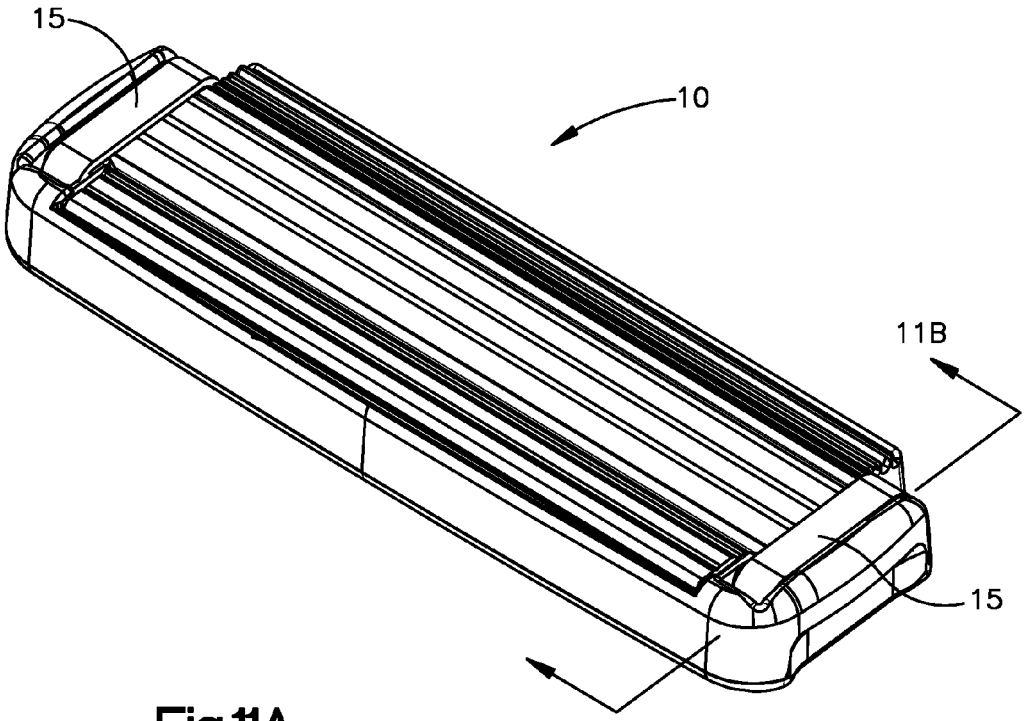
Fig.11A PRIOR ART
FIG. 11A is a diagram illustrating a prior art shaving cartridge.
Figure 11B:
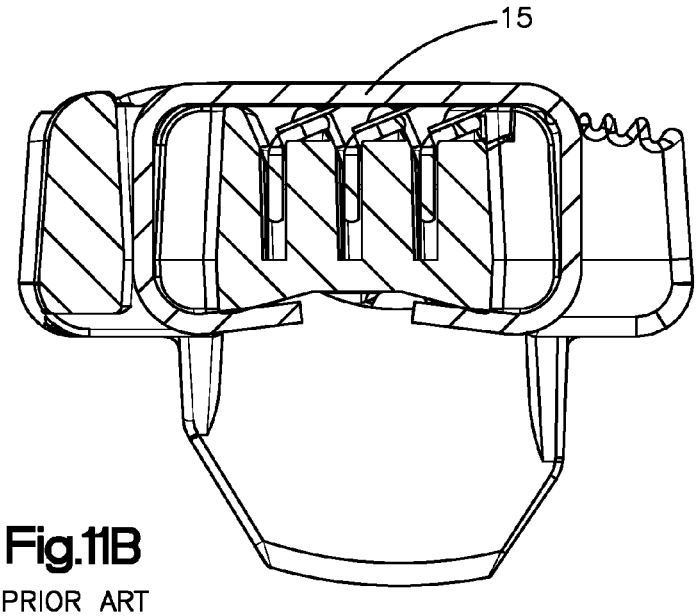
Fig.11B PRIOR ART
FIG. 11B is a diagram illustrating a cross-sectional view of the prior art shaving cartridge.

FIG. 10 is a diagram illustrating a perspective view of the retainer 200. Referring to FIG. 10, the retainer 200 includes a recess 209 that is formed on the top portion 201, and a protrusion 207 that extends downwardly from the top portion 201. The retainer 200 includes a front edge 221 that is adjacent to the guard bar 113 when the retainer 200 is secured to the razor cartridge 100, and a rear edge 219 that is adjacent to the cap 115 when the retainer 200 is secured to the razor cartridge 100. In this example, the recess 209 and the protrusion 207 extend along the entire top portion 201 of the retainer 200, from the rear edge 219 to the front edge 221. However, the recess 209 and the protrusion 207 may extend along only a portion of the retainer 200, and more than one recess 209 and protrusion 207 may be formed in different patterns along the top portion 201 of the retainer. Similarly, one or more recesses or protrusions may be formed on the bottom portion 203.

A variety of different benefits, not limited to those described herein, are provided in using the razor cartridge 100 and the retainer 200 compared to conventional clip heads. In an embodiment, the retaining load is applied equally along the entire length of the retainer 200 since the profile of the retainer 200 is the same along its entire length.

In another embodiment, bowing that is typically exhibited with the manufacture of conventional razor heads having the clip design is no longer an issue. Accordingly, a more stable blade edge exposure is attained in using the retainer 200. For example, in a razor cartridge designed to have blade exposures in line with the contact plane, the conventional razor head typically includes blade exposures ranging from 0-0.1 mm above the contact plane. This results from a bowing effect of the clip retaining elements in conventional razor heads. On the other hand, a similarly designed razor cartridge 100 using the retainer 200 may include actual blade exposures ranging from 0-0.06 mm. That is, a razor cartridge 100 using the retainer 200 may exhibit up to 40 percent improved stability in blade edge exposure.

In yet another embodiment, head assembly quality is improved with no possibilities of a clip leg being left unbent under the housing to fix and secure in place. Typically, during the manufacture of a conventional razor head including one or more clip retaining elements for securing blades to a razor cartridge, one or more of the clip retaining elements will remain unbent under the housing and will require further labor to fix and secure the clips in place. In using the razor cartridge 100 and the retainer 200, this manufacturing defect is avoided and head assembly quality is improved.

In an additional embodiment, efficiency of the manufacturing process is significantly improved and manufacturing costs are reduced. In manufacturing a conventional razor head including one or more clip retaining elements, at least a three step process is employed. First, the clip retaining elements are positioned with respect to the housing; second, the clip retaining elements are placed within one or more apertures within the housing; third, the legs of the clip retaining elements are bent and wrapped beneath the housing. Alternatively, for the manufacture of the razor cartridge 100 and the retainer 200, the retainer may be provided and directly fitted to the housing in a single step process. In addition, the materials and dimensions of a clip retaining element typically require a third party manufacturer to provide the clip retaining elements. Alternatively, the larger dimensions and shape of the retainer 200 in accordance with the described embodiments provide for significantly reduced manufacturing costs.

One of skill in the art will recognize that the described examples are not limited to any particular size. Further one of skill in the art will recognize that the components of the retainer 200 are not limited to any type of material. In a preferred example, the retainer 200 is formed of a metal material but may be formed of a variety of different materials including plastic. One skilled in the art will recognize that diameters, types and thicknesses of preferred materials can be utilized when taking into consideration design and stability considerations. A number of manufacturing techniques may be used such as the molding, machining, or casting of any component.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A shaving blade unit comprising:

a housing having a top surface, a bottom surface, a front edge, a rear edge, and a pair of side edges extending between the front edge and the rear edge, the housing having a plurality of blades disposed between the front edge and the rear edge, each of the plurality of blades having a cutting edge exposed at the top surface of the housing; and a pair of independent retainers each having a top portion, a bottom portion, and a convex portion connecting the top portion to the bottom portion, each of the retainers extending along a respective one of the pair of side edges between the front edge of the housing and the rear edge of the housing, wherein the top portion of each of the retainers extends over a portion of the top surface of the housing to retain the plurality of blades in the housing, wherein the convex portion includes a continuous curvature from the top portion to the bottom portion, wherein the bottom portion of each of the retainers is curved around the bottom surface of the housing, and wherein each of the retainers includes a protrusion and a recess formed on opposite surfaces of the top portion.

2. The shaving blade unit of claim 1, wherein the top portion of each of the retainers is planar, comprises a face and the protrusion is positioned about 1 mm to about 3 mm from the face.

3. The shaving blade unit of claim 2, wherein each of the protrusions extends downwardly from the top portion and comprises a triangular shape.

4. The shaving blade unit of claim 2, further comprising a pair of housing recesses each extending along a respective one of the pair of side edges for receiving a respective one of the retainers.

5. The shaving blade unit of claim 4, further comprising a corresponding surface formed on each housing recess for receiving the protrusion.

6. The shaving blade unit of claim 5, wherein the protrusion and the corresponding surface have the same shape, and comprise a triangular shape.

7. The shaving blade unit of claim 1, wherein each of the retainers comprises a front edge and a rear edge, and the protrusion extends between the front edge and the rear edge of each of the retainers.

8. The shaving blade unit of claim 7, wherein the front edge and the rear edge of each of the retainers is a continuous coplanar edge defined by the top portion, the bottom portion, and the convex portion of a respective one of the retainers.

9. The shaving blade unit of claim 1, wherein each of the recesses comprises a semi-circular shape.

10. The shaving blade unit of claim 1, wherein the continuous curvature extends along the bottom portion and the continuous curvature along the bottom portion is in continuous contact with the bottom surface of the housing.

11. A shaving blade unit comprising:

a housing having a top surface, a bottom surface, a front edge, a rear edge, and a pair of side edges extending between the front edge and the rear edge, the housing having a plurality of blades disposed between the front edge and the rear edge, each of the plurality of blades having a cutting edge exposed at the top surface of the housing;

a pair of independent retainers each having a top portion, a bottom portion, a convex portion connecting the top portion to the bottom portion, and an inner surface, each of the retainers extending along a respective one of the pair of side edges between the front edge of the housing and the rear edge of the housing; and a protrusion disposed on the inner surface of each of the retainers, wherein the top portion of each of the retainers extends over a portion of the top surface of the housing to retain the plurality of blades in the housing, wherein the convex portion includes a continuous curvature from the top portion to the bottom portion, wherein the bottom portion of each of the retainers is curved around the bottom surface of the housing, and wherein the continuous curvature extends along the bottom portion and the continuous curvature along the bottom portion is in continuous contact with the bottom surface of the housing.

12. The shaving blade unit of claim 11, wherein the top portion of each of the retainers is planar and comprises a face and the protrusion is positioned about 1 mm to about 3 mm from the face.

13. The shaving blade unit of claim 11, wherein each of the retainers comprises a front edge and a rear edge, and the protrusion extends between the front edge of a respective one of the retainers and the rear edge of the one of the retainers.

14. The shaving blade unit of claim 13, wherein the front edge and the rear edge of each of the retainers is a continuous coplanar edge defined by the top portion, the bottom portion, and the convex portion of a respective one of the retainers.

15. The shaving blade unit of claim 11, wherein each of the protrusions extends downwardly from the top portion and comprises a triangular shape.

16. The shaving blade unit of claim 11, further comprising a recess disposed on the top portion of each of the retainers, wherein each of the recesses comprises a semi-circular shape.

17. The shaving blade unit of claim 11, further comprising a pair of housing recesses each extending along a respective one of the pair of side edges for receiving a respective one of the pair of retainers.

18. The shaving blade unit of claim 17, further comprising a corresponding surface formed on each housing recess for receiving one of the protrusions.

19. The shaving blade unit of claim 18, wherein each of the protrusions and each of the corresponding surfaces have the same shape, and comprise a triangular shape.

20. The shaving blade unit of claim 11, wherein each of the retainers includes a recess, the protrusion and the recess formed on opposite surfaces of the top portion.

21. A shaving blade unit comprising:

a housing having a top surface, a bottom surface, a front edge, a rear edge, and a pair of side edges extending between the front edge and the rear edge, the housing having a plurality of blades disposed between the front edge and the rear edge, each of the plurality of blades having a cutting edge exposed at the top surface of the housing;

a pair of independent retainers each having a top portion, a bottom portion, a convex portion connecting the top portion to the bottom portion, an inner surface, a front edge, and a rear edge, the retainers extending along a respective one of the pair of side edges between the front edge of the housing and the rear edge of the housing;

a protrusion disposed on the inner surface of each of the retainers; and a recess disposed on the top portion of each of the retainers and extending between the front edge of each retainer and the rear edge of each retainer, wherein the top portion of each of the retainers extends over a portion of the top surface of the housing to retain the plurality of blades in the housing, wherein the convex portion includes a continuous curvature from the top portion to the bottom portion, wherein the bottom portion of each of the retainers is curved around the bottom surface of the housing, and wherein the continuous curvature extends along the bottom portion and the continuous curvature along the bottom portion is in continuous contact with the bottom surface of the housing.

22. The shaving blade unit of claim 21, wherein the top portion of each of the retainers is planar and comprises a face and the protrusion is positioned about 1 mm to about 3 mm from the face.

23. The shaving blade unit of claim 21, wherein each of the protrusions extends between the front edge of a respective one of the retainers and the rear edge of the one of the retainers.

24. The shaving blade unit of claim 23, wherein the front edge and the rear edge of each of the retainers is a continuous coplanar edge defined by the top portion, the bottom portion, and the convex portion of a respective one of the retainers.

25. The shaving blade unit of claim 21, wherein each of the protrusions extends downwardly from the top portion and comprises a triangular shape.

26. The shaving blade unit of claim 21, wherein each of the recesses comprises a semi-circular shape.

27. The shaving blade unit of claim 21, further comprising a pair of housing recesses each extending along a respective one of the pair of side edges for receiving a respective one of the pair of retainers.

28. The shaving blade unit of claim 27, further comprising a corresponding surface formed on each housing recess for receiving the protrusion.

29. The shaving blade unit of claim 28, wherein each of the protrusions and each of the corresponding surfaces have the same shape, and comprise a triangular shape.

30. The shaving blade unit of claim 21, wherein the protrusion and the recess are formed on opposite surfaces of the top portion.

31. A shaving blade unit comprising:

a housing having a top surface, a bottom surface, a front edge, a rear edge, and a pair of side edges extending between the front edge and the rear edge, the housing having a plurality of blades disposed between the front edge and the rear edge, each of the plurality of blades having a cutting edge; and a pair of independent retainers each having a top portion, a bottom portion, and a convex portion connecting the top portion to the bottom portion, each of the retainers extending along a respective one of the pair of side edges between the front edge of the housing and the rear edge of the housing, wherein the convex portion includes a continuous curvature from the top portion to the bottom portion, wherein the bottom portion of each of the retainers is curved around the bottom surface of the housing, wherein each of the retainers is preloaded thereby securing each retainer to the housing via a spring force with each of the retainers having an installed configuration that is different than an uninstalled configuration prior to being installed on the housing with each of the retainers biased apart in the installed configuration, and wherein the continuous curvature extends along the bottom portion and the continuous curvature along the bottom portion is in continuous contact with the bottom surface of the housing.

32. The shaving blade unit of claim 31, wherein the top portion of each of the retainers comprises a face and a protrusion is positioned about 1 mm to about 3 mm from the face.

33. The shaving blade unit of claim 32, wherein each of the protrusions extends downwardly from the top portion and comprises a triangular shape.

34. The shaving blade unit of claim 31, wherein each of the retainers comprises a front edge, a rear edge, and a protrusion extending between the front edge and the rear edge of each of the retainers.

35. The shaving blade unit of claim 34, wherein the front edge and the rear edge of each of the retainers is a continuous coplanar edge defined by the top portion, the bottom portion, and the convex portion of a respective one of the retainers.

36. The shaving blade unit of claim 31, further comprising a recess disposed on the top portion of each of the retainers, wherein each of the recesses comprises a semi-circular shape.

37. The shaving blade unit of claim 31, wherein each of the retainers is stretched during installation on the housing to form the spring force so that, when each of the retainers is in the installed configuration, the bottom portion of each of the retainers is farther away from the top portion of each of the retainers than in the uninstalled configuration.

38. The shaving blade unit of claim 31, wherein each of the retainers includes a protrusion and a recess formed on opposite surfaces of the top portion.

39. The shaving blade unit of claim 31, wherein each of the retainers is expanded in the installed configuration and unexpanded in the uninstalled configuration.

* * * * *